United States Patent [19]

Schmachtel

[11] 4,194,438

[45] Mar. 25, 1980

[54] FLEXIBLE TUBE BAGGING MACHINE

[75] Inventor: Florian Schmachtel, Grossen-Linden, Fed. Rep. of Germany

[73] Assignee: ROVEMA Verpackungsmaschinen GmbH & Co. KG., Giessen, Fed. Rep. of Germany

[21] Appl. No.: 861,975

[22] Filed: Dec. 19, 1977

[30] Foreign Application Priority Data

Dec. 21, 1976 [DE] Fed. Rep. of Germany ..... 2657790

[51] Int. Cl.[2] ..... B31B 1/38

[52] U.S. Cl. ..... 93/20; 93/82

[58] Field of Search ..... 93/82, 20, 19, 14; 53/551, 552

[56] References Cited

U.S. PATENT DOCUMENTS

| | | | |
|---|---|---|---|
| 1,986,422 | 1/1935 | Zwoyer | 53/551 X |
| 3,415,171 | 12/1968 | Wilson | 53/551 X |
| 3,426,499 | 2/1969 | Paige | 53/551 X |
| 3,494,265 | 2/1970 | Middour | 93/82 |
| 4,043,098 | 8/1977 | Putnam, Jr. et al. | 53/551 |

*Primary Examiner*—James F. Coan

*Attorney, Agent, or Firm*—Blanchard, Flynn, Thiel, Boutell & Tanis

[57] ABSTRACT

A flexible tube bagging machine having a feed device for a foil, a shaping member over which the foil is drawn and formed into a tube and a foil transfer device arranged downstream of the shaping member. The shaping member has a sleeve portion and a collar for engaging the foil. The collar is secured to the sleeve portion and guides the foil inside of the sleeve portion. The collar has a collar neck portion and two collar chest portions connected to the collar neck portion and face outwardly from a front side of the machine. The collar chest portions converge in a conveying direction of the foil and effect a guiding of the lateral edges of the foil toward one another. The collar chest portions are of different length and the longer collar chest portion extends through a central plane extending through the longitudinal axis of the sleeve portion to a position adjacent an opposed edge of the cutout and being perpendicular to the front side of the machine. The collar neck portion is asymmetrical with respect to the central plane and the part which lies on the side of the longer collar chest portion is wider than the other part thereof.

1 Claim, 7 Drawing Figures

FLEXIBLE TUBE BAGGING MACHINE

FIELD OF THE INVENTION

The invention relates to a flexible tube bagging machine having a feed device for a foil, a shaping member, over which the foil is drawn and thereby is formed into a tube and a foil transfer device, which viewed with respect to the transporting direction of the foil is arranged behind the shaping member and the shaping member has a sleeve portion and a collar for engaging the foil, which collar is secured to said sleeve portion, said collar guiding the foil inside of the sleeve portion, which collar has a collar neck portion and two collar chest portions, which are connected to said collar neck portion and rest on the front side of the machine, which collar chest portions converge viewed in conveying direction of the foil and guide the edge areas of the foil toward one another.

BACKGROUND OF THE INVENTION

In flexible tube bagging machines the shaping member effects the deformation of a flat foil, which is pulled off from a roll, to a tubular formation. The edges of the foil are hereby overlapped and are connected to one another, after passage of the shaping member at the overlapping points, by welding, sealing or gluing, after which an all around sealed tube is produced, which is divided into individual bags through transverse seams.

Known shaping members are constructed symmetrically, namely the collar chest portions are substantially of equal length and converge toward the center plane of the shaping member. Center plane is here the plane, which extends through the axis of the sleeve portion and the center of the collar neck portion. As a rule the axis of the sleeve portion extends perpendicularly and the mentioned center plane is positioned at a right angle to the front side of the machine. With this also overlapping of the foil edges approximately in the center plane takes place. The constructively favorable arrangement of transverse sealing jaws, with which transverse seams for forming of bags are produced, is the arrangement which is parallel to the front side of the machine. In this common arrangement, longitudinal seams are obtained with the known shaping members at one flat side of the finished bag. The position of the longitudinal seam is advantageous in the case of a flat bag and also does not interfere.

In the case of some bag forms, so in particular in the case of square bags which can stand, it is desired that the longitudinal seam does not extend in the area of a flat side, because this is not advantageous for the appearance of the bag and because the pressure of longitudinal sealing jaws on the flat side of a fill pipe is problematic. A flat sidewall of a fill pipe has in comparison with a pipe the wall of which is arced, for example a pipe having a circular cross section, only a small rigidity. These disadvantages are avoided when the longitudinal seams are moved into the area of a bag edge, because a longitudinal sealing jaw can then be engaged in the vicinity of an edge of the fill pipe and thus find a stiff abutment.

Such a position of the longitudinal welding seam has been achieved up to now by either arranging the transverse sealing jaws which act as the foil transfer tongs suitably staggered or by supplying the foil, generally also called wrapping material, from the side. Both require special machine constructions, which are substantially more expensive than standard flexible tube bagging machines, in which the wrapping material is supplied from the backside of the machine and the transverse sealing jaws are aligned parallel to the front side of the machine.

The basic purpose of the invention is to construct a flexible tube bagging machine of the above-mentioned type so that also in the case of the mentioned standard arrangement the longitudinal seam of the bags can be moved from the mentioned center plane into the vicinity of a bag edge.

This purpose is attained according to the invention by the collar chest parts being of different length and the longer collar chest portion being guided beyond the center plane of the shaping member, which extends through the longitudinal axis of the sleeve portion and the center of the collar neck portion.

In the case of a flexible tube bagging machine which is constructed in the above manner, in spite of supplying the wrapping material from the backside of the machine and in spite of the arrangement of the shaping member such that its collar chest portions rest on the front side of the machine, it is achieved that overlapping of the foil edges is moved far from the mentioned center plane. It is therefore easily possible, in the case of a for example square bag to move the longitudinal seal into the area of the bag edge. Therefore, it is possible with the aid of the invention to maintain the structurally particularly advantageous standard arrangement in which the transverse sealing jaws extend parallel to the front side of the machine and the wrapping material is supplied from behind. Such a machine is substantially more advantageous than special constructions having tong transfer devices and the transverse sealing jaws are rotated from the front plane of the machine or as machines having a lateral feed of the wrapping material. It is possible to use, even when a lateral arrangement of the longitudinal seam is desired, basic forms of machines which are produced in series and which differ substantially only in using an inventive asymmetric shaping member from standard machines.

As can be seen from the above discussions, the invention is particularly advantageous, when the fill pipe of the flexible tube bagging machine and thus also the sleeve portion have a nonround cross section. In particular the embodiment wherein the sleeve portion has a rectangular cross section is particularly of a great importance because with it square-shaped bags can be manufactured, in which the longitudinal seal extends in the area of a bag edge. The bags can also have large-surface sidewalls, since the flexibility of a plane fill pipe wall is no longer disadvantageous, because the contact pressure of the longitudinal sealing jaw occurs in the area of a stiff side edge of the fill pipe.

The collar neck portion is preferably also constructed asymmetrically. This is advantageous because a larger portion of the width of the wrapping material strip must be pulled to the longer collar chest portion than to the shorter collar chest portion.

BRIEF DESCRIPTION OF THE DRAWINGS

One exemplary embodiment of the invention is illustrated in the drawings, in which.

DETAILED DESCRIPTION

Figure 2:
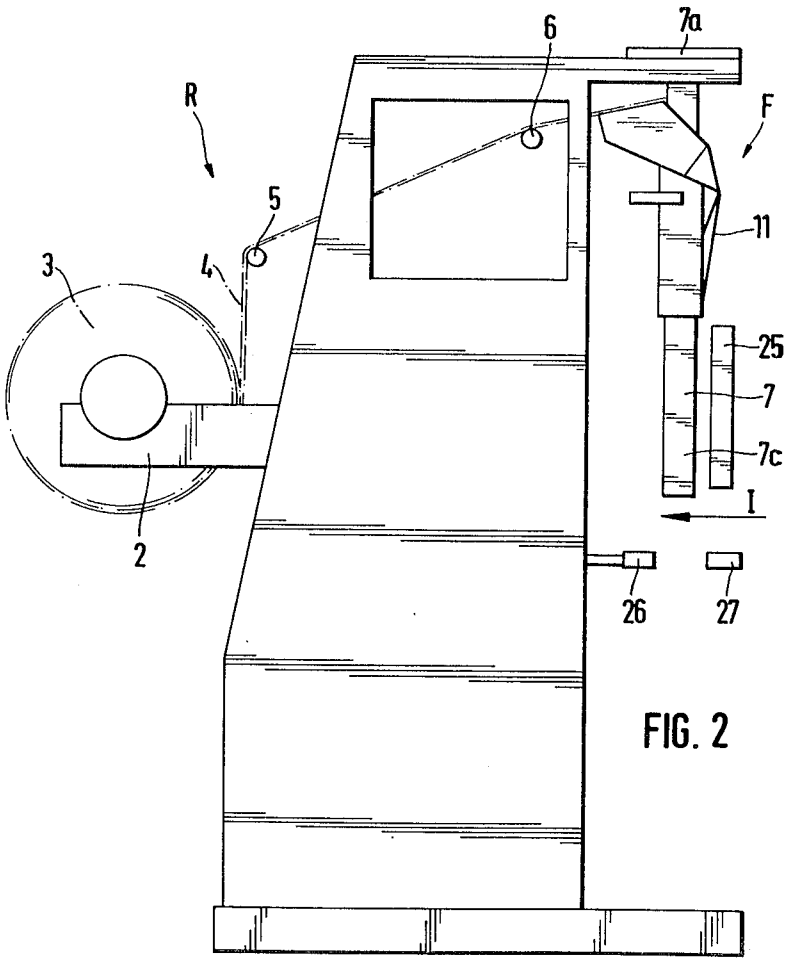
FIG. 2 is a side view of the flexible tube bagging machine according to FIG. 1 in the direction of the arrow II of FIG. 1.
Figure 1:
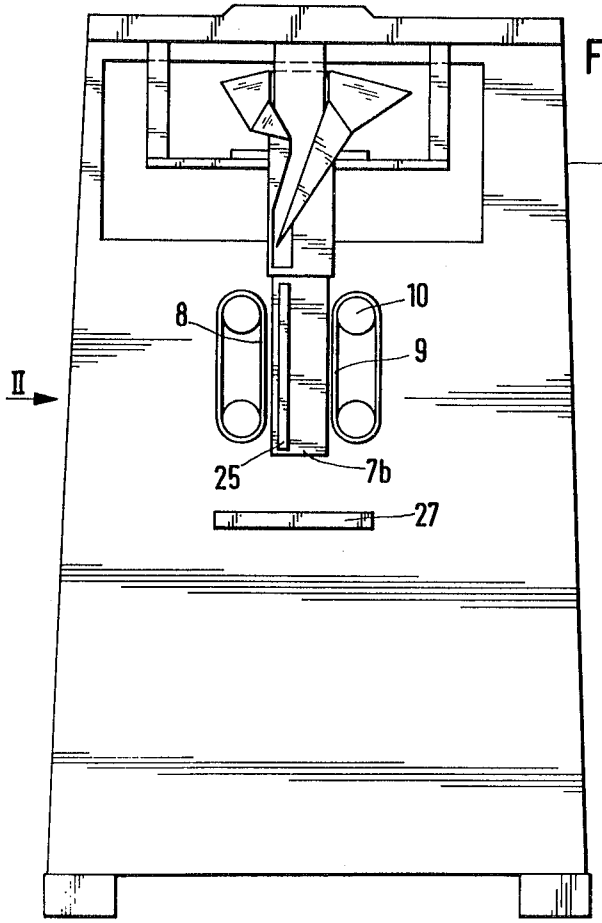
FIG. 1 is a much simplified illustration of a front view of an inventive flexible tube bagging machine corresponding with the arrow I of FIG. 2.

The flexible tube bagging machine which is illustrated in FIGS. 1 and 2 has a frame 1, which is constructed box-like and houses all of the driving elements of the machine. The front side of the machine is identified generally with F and the backside of the machine is identified generally with R.

A mounting bracket 2 for receiving a roll 3 is provided on the backside of the machine, which roll consists of a wound-up strip 4 of wrapping material. For example it may be a weldable plastic foil. However, it is also possible to use different wrapping materials, as for example paper. The wrapping material strip 4 is guided over guide rollers 5 and 6 from the backside R of the machine to its front side F.

A fill pipe 7, which extends to the head of the machine and terminates at 7*a* is provided on the front side F of the machine. A not shown dosing device cooperates with the mouth 7*a* of the fill pipe 7, with which dosing device material which must be packaged is filled proportionately into the fill pipe 7. In the illustrated exemplary embodiment, the fill pipe 7 has a rectangular cross section, since square-shaped packages are to be manufactured. A wide side 7*b* of the fill pipe 7 is illustrated in FIG. 1 and a narrow side 7*c* in FIG. 2. The wide sides 7*b* extend thus parallel to the front side F of the machine and the narrow sides 7*c* extend at a right angle to the front side.

Transfer belts 8 and 9 are arranged on the narrow sides 7*c* of the fill pipe. These are continuous belts, which are guided over guide rollers 10 and press the wrapping material strip 4 which is formed into a tube against the narrow sides 7*c*. During the step-by-step movement of the belts, a part of the wrapping material strip 4 is pulled downwardly. The increment of movement corresponds in each case approximately with one bag length.

The upper area of the fill pipe 7 is surrounded by a shaping member which is identified as a whole with reference numeral 11, which is illustrated more precisely in FIGS. 3 to 7 and will be viewed more in detail hereinafter with reference to these figures.

The shaping member 11 has a sleeve portion 12 and a collar 13. The sleeve portion 12 has, as it can particularly be seen from FIGS. 5 to 7, a rectangular cross section having short sides 14, 15 and long sides 16, 17. The sides transform into one another through rounded parts. The sides 14, 16 and 15 are closed, while the side 17 has a cutout portion 18, which has the form visible from FIG. 7.

The sleeve portion 12 is cut off perpendicularly to its longitudinal axis at its lower end, while (see here FIG. 4) the upper end of the sleeve portion 12 is cut off inclined to its longitudinal axis. Projections 19 exist on the sleeve portion 12, which projections serve to fasten the shaping member to the machine.

Figure 3:
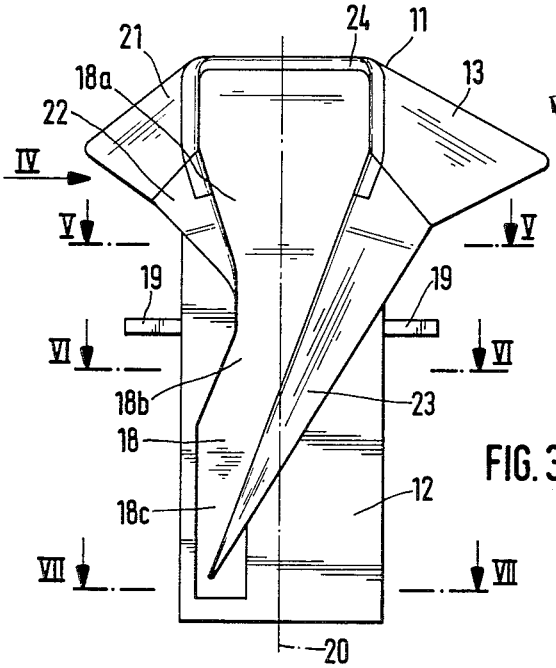
FIG. 3 is a front view of an inventive shaping member.
Figure 4:
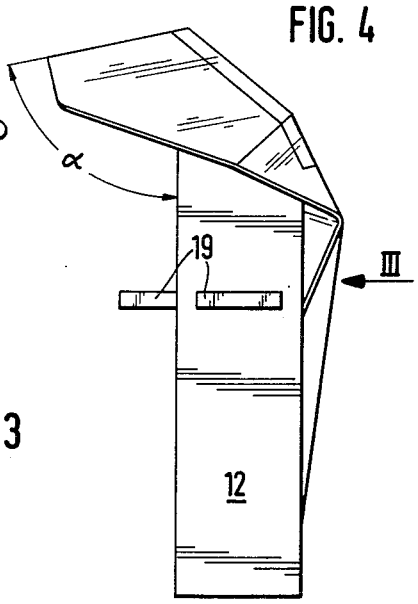
FIG. 4 is a side view of the shaping member in direction of the arrow IV of FIG. 3, and FIGS. 5 to 7 are horizontal cross-sectional views taken along the lines V—V, VI—VI and VII—VII of FIG. 3.

A dash-dotted line 20 is shown in FIG. 3. Said line defines a center plane of the shaping member, which extends through the longitudinal axis 21 (see FIG. 5) of the sleeve portion 12 and extends at a right angle to the drawing plane. As shown in FIG. 3, the cutout portion 18 is in its upper area 18*a* approximately symmetrical to the center plane 20, while a center area 18*b* of the cutout section extends inclined to the center plane 20 and a lower area 18*c* extends parallel to the center plane, however, is offset strongly laterally with respect to same.

The collar 13 has a neck portion 21 and two collar chest portions 22 and 23. The collar chest portion 23 is substantially longer than the collar chest portion 22 and extends beyond the center plane 20. The collar chest portion 22, however, does not at all extend to the center plane.

The collar neck portion 21 is constructed also slightly nonsymmetrical and the area which is on the right of the center plane 20 is wider than the area which is on the left of the center plane 20. The upper edge of the collar neck portion 21 has a reinforcement 24 of wear-resistant material, for example of hardened steel. The edge reinforcement extends over a certain area also into the edges of the collar chest portion 22, 23.

Figure 5:
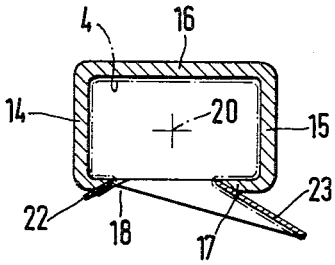
Figure 6:
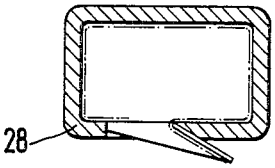
Figure 7:
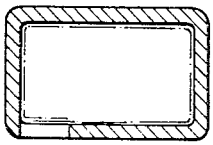

As one can recognize from the cross section according to FIG. 5, the collar chest portions 22 and 23 have a certain inclination toward the front wall 17 of the sleeve portion 12 and the direction of inclination of the two collar chest portions 22 and 23 is opposite thereto.

A space exists between the outside of the fill pipe 7 and the inside of the sleeve portion 12, through which space the wrapping material strip 4 is pulled.

A longitudinal sealing jaw 25 is arranged in the lower area of the fill pipe 7 parallel to said fill pipe, namely (here see FIG. 1) in the area of one edge of the fill pipe 7. Two transverse sealing jaws 26 and 27 are arranged below the fill pipe 7, which jaws can be moved toward one another.

OPERATION

The inventive machine operates as follows:

The wrapping material strip 4 is pulled by means of the transfer belts 8 and 9 step-by-step into the shaping member 11. The wrapping material strip lies thereby on the surface of the neck portion 21 and the outsides of the collar chest portions 22, 23, which outsides are visible in FIG. 3. During a forming of the wrapping material strip 4 to a tube, the wrapping material strip is pulled over the edge reinforcement 24. The edge areas of the wrapping material strip 4 are pulled over the collar chest portion 23 and the foil has in the various elevated areas of the shaping member the positions illustrated by dashes in the cross-sectional views according to FIGS. 5 to 7. As one can see from FIG. 5, the largest part of the foil rests below the reinforced edge 24 on the inside of the sleeve portion 12. This is achieved together with the fill pipe which is not shown in FIGS. 5 to 7, which fill pipe leaves free only a narrow gap between the inner wall of the sleeve portion 12 and outer wall of the fill pipe. The wrapping material strip 4 is pulled into said gap.

Due to the nonsymmetric construction of the shaping member, an overlapping of the edge areas of the foil is formed in the area of the edge 28, which overlapping is created approximately in the area of the cross-sectional place VII—VII. The overlapping point extends during a further movement by means of the transfer belts 8, 9 below the longitudinal sealing jaw 25. During a standstill time of the foil, the longitudinal sealing jaw 25 is pressed onto the fill pipe 7 and the overlapping edge areas of the foil are welded together using heat, which is produced in the longitudinal sealing jaw, sealed together and glued together. This fixes the tube shape of the wrapping material strip 4.

The forming of the flexible tube takes place moreover in a conventional manner, namely the transverse sealing jaws 26, 27 produce simultaneously a head seam on a lower bag and a bottom seam on an upper bag. Simultaneously with the manufacture of these seams or shortly thereafter, the lower finished bag is separated between the two transverse seams from the upper bag, which must still be produced. Filling of the bag, which is still empty, not separated and has a bottom seam and a longitudinal seam, is accomplished by the fill pipe 7 into which by means of a dosing device located thereabove a correctly measured portion of fill material is dispensed for filling the bag.

As one can see from FIGS. 1 and 2, the machine has in spite of the arrangement of the longitudinal seam in the area of one bag edge the common standard arrangement in which the wrapping material strip is arranged on the backside R of the machine and the transverse sealing jaws 26, 27 lie parallel to the front side F of the machine. This arrangement is both spatially particularly advantageous (the machine requires to the side only little space) and is also structurally of an advantage because the movement mechanism for the transverse sealing jaws 26, 27 is most simple when their movement occurs at a right angle to the front side F of the machine. An important economic factor is that all parts of the machine are the same as in the standard machines and only special shaping members must be used.

The invention was discussed with reference to the manufacture of square-shaped bags, which manufacture is presently practically the first one to be considered. However, the invention is not supposed to be limited to same, because it can be of an advantage also in connection with other bag shapes. Thus, it is preferable for example also in the case of common flat tubular bags, which are formed around a fill pipe having a circular cross section, to shift the longitudinal seam from the center of the flat side of a bag, for example when on both sides of the tubular bag a lettering or an illustration is displayed.

The intake angle $\alpha$ between the longitudinal axis of the sleeve portion 12 and the upper contact plane at the collar (see FIG. 4) is selected depending on the material to be processed. This suitable selection of the intake angle is already known in symmetrical shaping members. In the case of the asymmetrical shaping member according to the invention, the same intake angles are chosen preferably for a given material. In the case of poor forming materials, the intake angle $\alpha$ is generally larger than in the case of easy to form materials. It can be of between for example 20° for a very good forming material up to 180° for a poor forming material. In the latter case, the mentioned plane of contact would lie approximately parallel to the sleeve portion.

The embodiments of the invention in which an exclusive property or privilege is claimed are defined as follows:

1. In a flexible tube bagging machine having a feed device for a foil, a shaping member over which said foil is drawn and formed into a tube and a foil transfer device arranged downstream of said shaping member, said shaping member having a sleeve portion and a collar for engaging said foil, said collar being secured to said sleeve portion, said collar guiding said foil inside of said sleeve portion, said collar having a collar neck portion and two collar chest portions connected to said collar neck portion and facing outwardly from a front side of said machine, said collar chest portions converging in a conveying direction of said foil and effecting a guiding of the lateral edges of said foil toward one another, the improvement comprising wherein said sleeve portion has a rectangular cross section, the long sides of which extend parallel to said front side of said machine, wherein said sleeve portion has a cutout portion on said outwardly facing long side thereof, wherein said collar chest portions extend along the opposed edges of said cutout, wherein said collar chest portions are of different length, wherein the longer collar chest portion extends through a central plane extending through a central longitudinal axis of said sleeve portion to a position adjacent an opposed edge of said cutout and being perpendicular to said front side of said machine and wherein said collar neck portion is asymmetrical with respect to said central plane and the part which lies on the side of said longer collar chest portion is wider than the other part thereof.

* * * * *